US009613554B2

(12) United States Patent
Jang et al.

(10) Patent No.: US 9,613,554 B2
(45) Date of Patent: Apr. 4, 2017

(54) DISPLAY DRIVING METHOD AND INTEGRATED DRIVING APPARATUS THEREOF

(71) Applicant: Samsung Display Co., Ltd., Yongin, Gyeonggi-Do (KR)

(72) Inventors: Dae-Gwang Jang, Incheon (KR); Ung Gyu Min, Seoul (KR); Seok Ha Hong, Yongin-si (KR); Hyun Sik Hwang, Hwaseong-si (KR); Byung Sun Kim, Seoul (KR); Sang Mi Kim, Yongin-si (KR); Bong Hyun You, Yongin-si (KR); Ji Myoung Seo, Daegu (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 221 days.

(21) Appl. No.: 13/949,665

(22) Filed: Jul. 24, 2013

(65) Prior Publication Data

US 2014/0085276 A1 Mar. 27, 2014

(30) Foreign Application Priority Data

Sep. 24, 2012 (KR) ..... 10-2012-0105769

(51) Int. Cl.
*G09G 3/20* (2006.01)

(52) U.S. Cl.
CPC ..... *G09G 3/20* (2013.01); *G09G 3/2007* (2013.01); *G09G 2310/0213* (2013.01); *G09G 2310/04* (2013.01); *G09G 2320/103* (2013.01); *G09G 2330/021* (2013.01); *G09G 2340/0435* (2013.01); *G09G 2360/16* (2013.01)

(58) Field of Classification Search
CPC ..... G09G 2310/04; G09G 2330/021; G09G 3/3629; G09G 2310/0232; G09G 3/3666; G09G 2320/0252
See application file for complete search history.

(56) References Cited

U.S. PATENT DOCUMENTS 5,576,731 A * 11/1996 Whitby et al. ..... 345/100
5,613,103 A * 3/1997 Nobutani et al. ..... 345/556
(Continued)

FOREIGN PATENT DOCUMENTS

JP 2006084758 A 3/2006
KR 1020080110232 A 12/2008
(Continued)

OTHER PUBLICATIONS

European Search Report dated Jan. 27, 2014 of the corresponding European Patent Application No. 13179818.3.

*Primary Examiner* — Nicholas Lee
*Assistant Examiner* — Duane N Taylor, Jr.
(74) *Attorney, Agent, or Firm* — Cantor Colburn LLP

(57) ABSTRACT

A driving method of a display device includes: determining each of a plurality of pixel rows of the display device as one of a motion picture display pixel row and a still image display pixel row by comparing image data of each of the pixel rows in a current frame and in a previous frame; and driving the motion picture display pixel row with a motion picture frequency and driving the still image display pixel row with a still image display frequency, which is lower than or equal to the motion picture frequency, where a plurality of still image display pixel rows are driven with at least two still image display frequencies.

27 Claims, 16 Drawing Sheets

(56) References Cited

U.S. PATENT DOCUMENTS

| | | | | |
|---|---|---|---|---|
| 5,926,159 | A * | 7/1999 | Matsuzaki et al. | 345/97 |
| 6,414,669 | B1 * | 7/2002 | Masazumi | 345/98 |
| 7,269,048 | B2 | 9/2007 | Takashima | |
| 7,701,429 | B2 | 4/2010 | Kim et al. | |
| 8,014,518 | B2 | 9/2011 | King et al. | |
| 2001/0033278 | A1 | 10/2001 | Ohta et al. | |
| 2003/0122773 | A1 | 7/2003 | Washio et al. | |
| 2006/0044251 | A1 | 3/2006 | Kato et al. | |
| 2007/0273682 | A1 | 11/2007 | Yi et al. | |
| 2008/0198107 | A1 * | 8/2008 | Park et al. | 345/84 |
| 2009/0040151 | A1 | 2/2009 | Lee | |
| 2009/0303170 | A1 | 12/2009 | Chung et al. | |
| 2010/0128019 | A1 * | 5/2010 | Harada | 345/212 |
| 2010/0149167 | A1 | 6/2010 | Hasegawa et al. | |
| 2011/0115781 | A1 | 5/2011 | Park et al. | |
| 2011/0298818 | A1 * | 12/2011 | Mori | G09G 3/3208 345/589 |
| 2012/0001950 | A1 | 1/2012 | Kim | |

FOREIGN PATENT DOCUMENTS

| | | | |
|---|---|---|---|
| KR | 100965591 | | 6/2010 |
| KR | 1020110071384 | A | 6/2011 |
| KR | 101073605 | | 10/2011 |
| WO | 2012002258 | | 1/2012 |

* cited by examiner

DISPLAY DRIVING METHOD AND INTEGRATED DRIVING APPARATUS THEREOF

This application claims priority to Korean Patent Application No. 10-2012-0105769, filed on Sep. 24, 2012, and all the benefits accruing therefrom under 35 U.S.C. §119, the content of which in its entirety is herein incorporated by reference.

BACKGROUND (a) Field

The invention relates to a driving method of a display device and a driving apparatus of a display device.

(b) Description of the Related Art

Display devices include flat display devices of various kinds such as a liquid crystal display, an organic light emitting device, an electrophoretic display and a plasma display device, and display devices typically have a panel, a driving chip that drives the panel, a board and a system mounted with the driving chip.

In the display devices, a low voltage differential signaling ("LVDS") method may be used for data transmission at a high speed between the driving chip, the board and the system due to increased band width of the data transmission. In the display devices using the LVDS method, the operation speed may be increased and a low voltage may be used such that power consumption, an electromagnetic interference ("EMI") and manufacturing cost may be reduced.

The image displayed by the display device includes a motion picture, a displayed image of which is changing over time and a still image, a displayed image of which is not changing for a predetermined time. In the case of the still image, a pixel self-refresh ("PSR") technique, which is a technique of non-transmitting data, may be used to reduce the power consumption. However, the PSR technique is applied only to a data transmission method in which bi-directional communication is possible.

In a large sized display device, a partial region of a screen thereof may be used for displaying the motion picture, and all pixels are typically operated with a constant frequency when the motion picture is only displayed in the corresponding region and the still image is displayed in the rest of the region. In such large sized display device, power consumption may be substantially constant even when the motion picture is displayed in the partial region.

SUMMARY

Exemplary embodiments of the invention provide a driving method of a display device where a still image is displayed with a frequency lower than a motion picture frequency for displaying a motion picture, and a driving apparatus of the display device.

An exemplary embodiment of a driving method of a display device according to the invention includes: determining each of a plurality of pixel rows of the display device as one of a motion picture display pixel row and a still image display pixel row by comparing image data of each of the pixel rows in a current frame and in a previous frame; and driving the motion picture display pixel row with a motion picture frequency and driving the still image display pixel row with a still image display frequency, which is lower than or equal to the motion picture frequency, where a plurality of still image display pixel rows are driven with at least two still image display frequencies.

In an exemplary embodiment, a pixel row of the still image display pixel rows, which is adjacent to the motion picture display pixel row, may be driven with a higher frequency than a pixel row of the still image display pixel rows, which is distant from the motion picture display pixel row.

In an exemplary embodiment, the motion picture display pixel row may include a motion picture display area and a refresh region, which are disposed along a same gate line.

In an exemplary embodiment, the determining each of the pixel rows of the display device as one of the motion picture display pixel row and the still image display pixel row by the comparing the image data of the current frame and the image data of the previous frame may include: outputting the image data of the previous frame, which is stored in a frame memory of the display device, to a comparator of the display device, and storing the image data of the current frame to the frame memory of the display device; and comparing the image data of the current frame and the image data of the previous frame using the comparator.

In an exemplary embodiment, the image data in the current frame and the image data in the previous frame may be compared for each of the pixel rows in the comparator to compare whether the still image or the motion picture is displayed for each of the pixel rows.

In an exemplary embodiment, the method may further include storing data corresponding to a result of the comparison in the comparator to a line buffer memory of the display device.

In an exemplary embodiment, the data which is output from the comparator and is stored to the line buffer memory may be data of two bits, where zero (0) represents the still image and 1 represents the motion picture.

In an exemplary embodiment, when the still image display pixel row is disposed between two motion picture display pixel rows, the still image display pixel row may be operated with the motion picture frequency.

In an exemplary embodiment, the driving the motion picture display pixel row with the motion picture frequency and the driving the still image display pixel row with the still image display frequency may include controlling transmission of a gate-on voltage to a gate line of the display device using an output enable signal.

In an exemplary embodiment, when the gate-on voltage is not applied to a pixel connected to the gate line based on the output enable signal, a data voltage may be controlled not to be applied to the pixel.

In an exemplary embodiment, the driving of the still image display pixel rows with the still image display frequency, which is lower than or equal to the motion picture frequency may include: analyzing an optimization still image display frequency; determining an upper still image display frequency for the still image display pixel rows in an upper still image display area positioned above the motion picture pixel row; and determining a lower still image display frequency for the still image display pixel rows in a lower still image display area positioned below the motion picture pixel row.

In an exemplary embodiment, the determining the optimization still image display frequency may include: calculating a representative value based on an image pattern of the still image display pixel row; and selecting the optimization still image display frequency from a lookup table of the display device based on the calculated representative value.

In an exemplary embodiment, each of the determining the upper still image display frequency and the determining the lower still image display frequency may include: calculating a representative value of a corresponding still image display pixel row; and selecting the upper still image display frequency and the lower still image display frequency from the lookup table based on the calculated representative value of the corresponding still image display pixel row.

In an exemplary embodiment, each of the determining the upper still image display frequency and the determining the lower still image display frequency may further include calculating a weight value of the corresponding still image display pixel row, and the upper still image display frequency and the lower still image display frequency are selected from the lookup table based on a value acquired by multiplying the weight value and the calculated representative value of the corresponding still image display pixel row.

In an exemplary embodiment, the still image display frequency of the still image display pixel rows in the upper still image display area may be gradually increased from the upper still image display frequency to the motion picture frequency as the still image display pixel rows goes toward the motion picture display pixel row, and the still image display frequency of the still image display pixel rows in the lower still image display area may be gradually increased from the lower still image display frequency to the motion picture frequency as the still image display pixel rows goes toward the motion picture display pixel row.

In an exemplary embodiment, the still image display frequency may be increased nonlinearly from the upper still image display frequency to the motion picture frequency and from the lower still image display frequency to the motion picture frequency.

In an exemplary embodiment, when the upper still image display frequency or the lower still image display frequency is lower than the optimization still image display frequency, a corresponding still image display pixel row may be operated with the optimization still image display frequency.

An exemplary embodiment of a driving apparatus of a display device according to the invention includes: a still image/motion picture determining unit which receives an image data input from outside and determines whether a pixel row corresponding to the image data is a motion picture display pixel row or a still image display pixel row; a representative value calculating unit which calculates a representative value for each pixel row; a lookup table which stores a frequency corresponding to the representative value; and a driving frequency determining unit which determines whether the frequency corresponding to the representative value from the lookup table is appropriate to determine a final driving frequency, where the motion picture display pixel row is driven with a motion picture frequency, the still image display pixel row is driven with a still image display frequency lower than or equal to the motion picture frequency, and a plurality of the still image display pixel rows are driven with at least two still image display frequencies.

In an exemplary embodiment, the driving apparatus may further include a weight value calculating unit which provides a weight value, where the frequency may be selected from the lookup table based on a value acquired by multiplying the representative value and the weight value.

In an exemplary embodiment, the driving apparatus may further include an optimization still image display frequency extracting unit which calculates the representative value based on an image pattern of the still image display pixel row and selects a corresponding optimization still image display frequency from the lookup table based on the calculated representative value.

In an exemplary embodiment, the representative value may be a grayscale value or a luminance value.

In an exemplary embodiment, the representative value may be one of an average value, a peak value, and a maximum grayscale value.

In an exemplary embodiment, the weight value for a middle grayscale may be greater than the weight value for a maximum or a minimum grayscale.

In an exemplary embodiment, an area corresponding to the representative value may be calculated, and the weight value may be determined based on the area such that the weight value increases as the area increases.

In an exemplary embodiment, the driving apparatus may further include a position determining unit which determines a portion of a pixel of the display panel which receives the image data, where the position determined by the position determining unit may be transmitted to the still image/motion picture determining unit.

In an exemplary embodiment, the driving apparatus may further include a motion picture display pixel row determining unit which receives the position determined by the position determining unit and determines whether a pixel row including the pixel is the motion picture display pixel row or the still image display pixel row.

As described above, in exemplary embodiments of the driving method of the display panel and the driving apparatus of the display panel, the still image of is displayed in a portion of a screen with the low frequency when the motion picture is only displayed in another portion of the screen, thereby substantially reducing the power consumption.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION OF THE EMBODIMENTS

Figure 1:
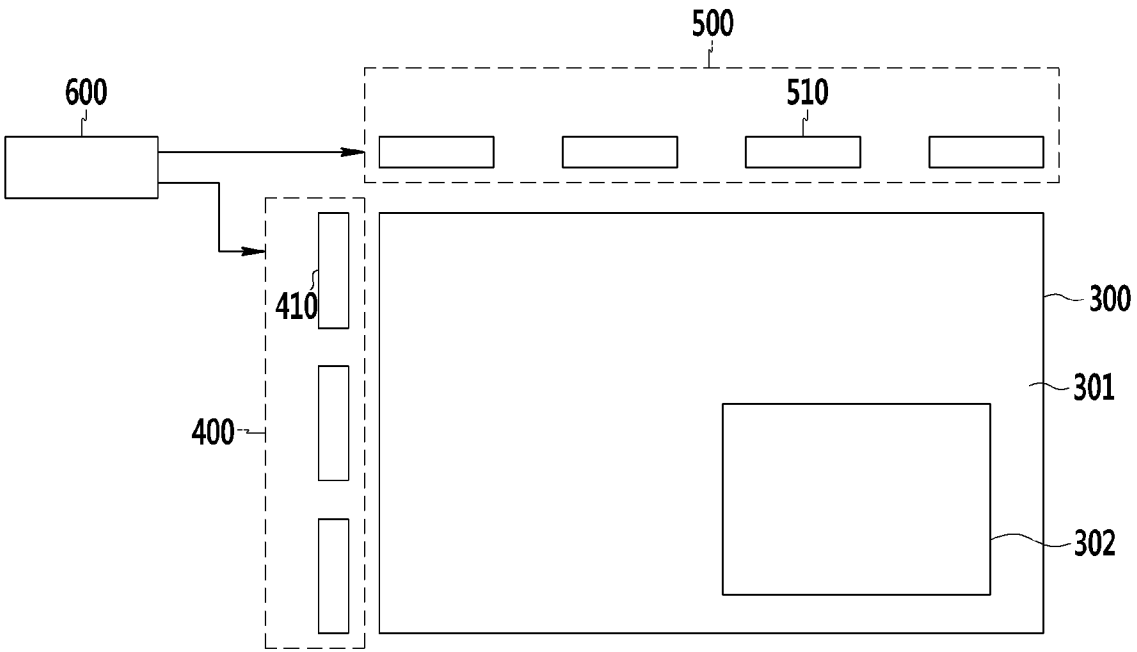
FIG. 1 is a block diagram showing an exemplary embodiment of a display device according to the invention.

The invention will be described more fully hereinafter with reference to the accompanying drawings, in which exemplary embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Now, exemplary embodiments of a display device according to the invention will be described with reference to accompanying drawings.

FIG. 1 is a block diagram showing an exemplary embodiment of a display device according to the invention.

Referring to FIG. 1, an exemplary embodiment of a display panel according to the invention includes a display area 300 that displays an image, a gate driver 400 that applies a gate voltage to a gate line of the display area 300, a data driver 500 that applies a data voltage to a data line of the display area 300, and a signal controller 600 that controls the display area 300, the gate driver 400 and the data driver 500.

The display area 300 includes pixels arranged substantially in a matrix form. In an exemplary embodiment, the display area 300 may include one of various flat display panels such as a liquid crystal panel, an organic light emitting panel, an electrophoretic display panel, an electrowetting display panel and a plasma display panel, for example. Hereinafter, an exemplary embodiment where the display area 300 includes the liquid crystal panel will be described for convince of description.

In an exemplary embodiment, the display area 300 includes a plurality of gate lines (not shown), e.g., signal lines extending in a transverse direction (or a first direction), and a plurality of data lines (not shown), e.g., signal lines extending in a longitudinal direction (or a second direction). In such an embodiment, the gate lines and the data lines are crossing and insulated from each other.

In an exemplary embodiment, each pixel includes a thin film transistor, a liquid crystal capacitor and a storage capacitor. A control terminal of the thin film transistor is connected to one gate line, an input terminal of the thin film transistor is connected to one data line, and an output terminal of the thin film transistor is connected to one terminal of the liquid crystal capacitor and one terminal of the storage capacitor. The other terminal of the liquid crystal capacitor is connected to the common electrode, and the other terminal of the storage capacitor receives a storage voltage applied from the signal controller 600.

According to an exemplary embodiment, a channel layer of the thin film transistor may include amorphous silicon or polysilicon.

The data lines receive the data voltage from the data driver 500, and the gate lines receive the gate voltage from the gate driver 400.

The data driver 500 is disposed at a side, e.g., an upper side or a lower side, of the display panel 100 and connected to the data lines extending in the longitudinal direction, and includes a plurality of data driving integrated circuits ("IC"s) 510. The data lines are divided and connected to the data driving ICs 510. Each data driving IC 510 selects and applies the data voltage to the data line based on the gray voltages generated in a gray voltage generator (not shown). In an exemplary embodiment, the data driving IC 510 may be disposed on a flexible printed circuit film ("FPC") and may be attached to the display panel.

The gate driver 400 alternately applies the gate-on voltage and the gate-off voltage to a plurality of gate lines, and the gate-on voltage is sequentially applied to the gate lines. The gate driver 400 may include a plurality of gate driving ICs 410. In an exemplary embodiment, the gate driving ICs 410 may be integrated at a side e.g., a right side or a left side, of the display area 300 in the display panel. The gate driver 400 receives a clock signal, a scan start signal, a low voltage corresponding to the gate-off voltage to generate the gate voltages (the gate-on voltage and the gate-off voltage), and sequentially applies the gate-on voltage to a plurality of gate lines.

The signal controller 600 outputs the control signal and the image data, to control the gate driver 400 and the data driver 500. In an exemplary embodiment, the signal controller 600 analyzes image data to be displayed to determine whether the image data is the still image or the motion picture. In such an embodiment, the signal controller 600 divides a region that displays the still image and a region that displays the motion picture based on the analysis of the image data, and divides a frequency to display the still image and a frequency to display the motion picture, thereby displaying the image. This will be described in detail with reference to FIG. 3.

Hereinafter, the display area 300 where the motion picture is displayed at a portion of the region of the display area 300 and where the still image is displayed at the rest of the region will be described with reference to FIG. 2.

Figure 2:
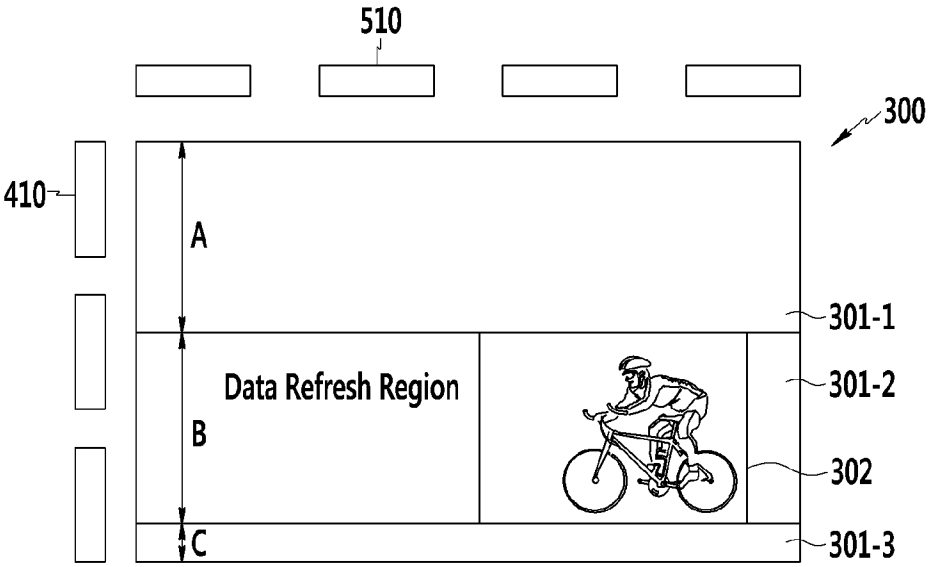
FIG. 2 is a block diagram showing a display screen of an exemplary embodiment of a display device when a motion picture is displayed only in a partial region of the display screen.

FIG. 2 is a block diagram showing a display screen of an exemplary embodiment of a display device when a motion picture is displayed only in a partial region of the display screen.

FIG. 2 shows the display area 300 where the motion picture is displayed in the partial region thereof and the still image is displayed in the rest of the region. In an exemplary embodiment, the display area 300 may be divided into a motion picture display area 302 and a plurality of still image display areas, e.g., a first still image display area 301-1, a second still image display area 301-2 and a third still image display area 301-3. In an exemplary embodiment, as shown in FIG. 2, the first and third still image display areas 301-1 and 301-3 disposed at a upper portion and a lower portion of the motion picture display area 302, respectively, and a display area that displays the still image is driven with a frequency lower than a general driving frequency (for example, 60 Hz). In one exemplary embodiment, the data voltage may be applied once every frame and the voltage applied in a frame may be maintained during the frame thereafter as the gate-on voltage applied to the gate line is applied one time during one frame. In such an embodiment, the second still image display area 301-2 disposed at a left side and a right side of the motion picture display area 302 shares the gate line with the motion picture display area 302 such that the still image is displayed in the second still image display area 301-2 with a frequency the same as a frequency of the motion picture display area 302 (hereinafter referred to as "a motion picture frequency"). In such an embodiment, when the second still image display area 301-2 is driven at 60 Hz, the still image is displayed by the data voltages corresponding to the still image are applied to each of the pixels in the second still image display area 301-2 60 times per second, thereby being refreshed (Data Refresh Region). The second still image display area 301-2 may be referred to as a refresh region. In an exemplary embodiment, the motion picture frequency may be the same as a general operation frequency for displaying the image when an entire of the image is the motion picture without the division of the image into the still image and the motion picture.

In an exemplary embodiment, the second still image display area 301-2 and the motion picture display area 302 disposed along same gate lines or sharing the gate line are referred to as a motion picture display pixel row B, and the pixel rows positioned under and on the motion picture display area 302 are referred to as still image display pixel rows A or C. In such an embodiment, the motion picture display pixel row B is driven with the motion picture frequency, and the still image display pixel row A or C is driven with the lower frequency than the motion picture frequency. However, the second still image display area 301-2 that displays the still image and shares the gate line with the motion picture display area 302 is driven with the motion picture frequency.

In an exemplary embodiment, a determination of whether an image on a portion of the display area 300 is the motion picture display area or the still image display area may be performed in the signal controller 600. This will be described with reference to FIG. 3 to FIG. 5.

Figure 3:
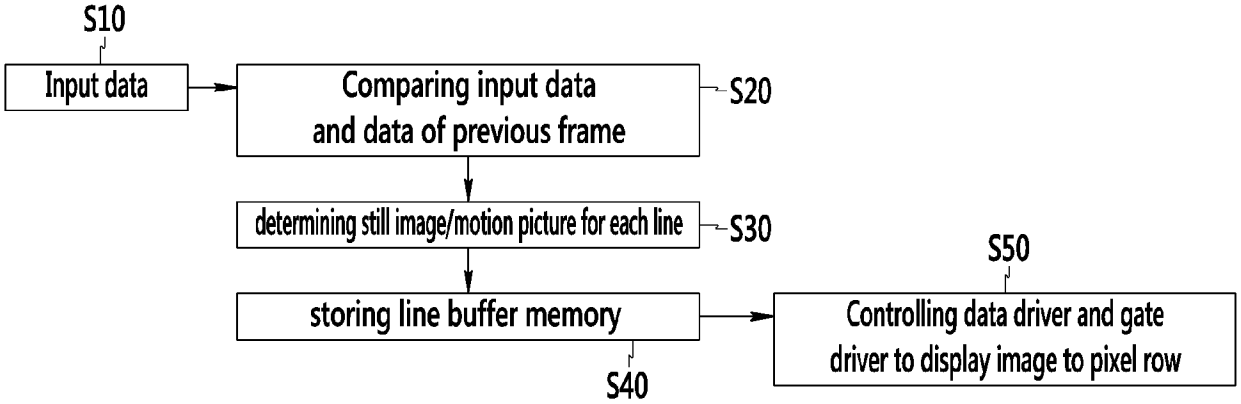
FIG. 3 is a flow chart showing an exemplary embodiment of a data processing of the display device according to the invention.
Figure 4:
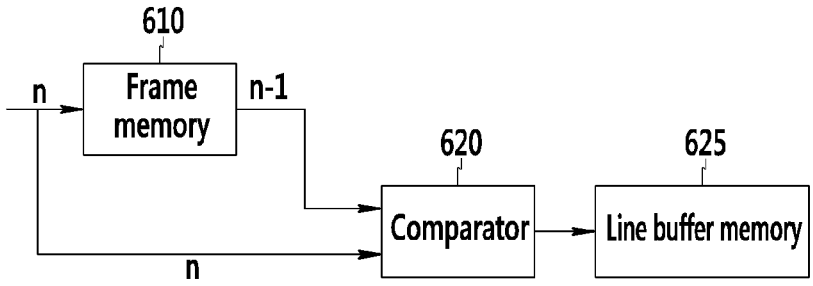
FIG. 4 is a block diagram showing a data processing sequence in an exemplary embodiment of a signal controller according to the invention.
Figure 5:
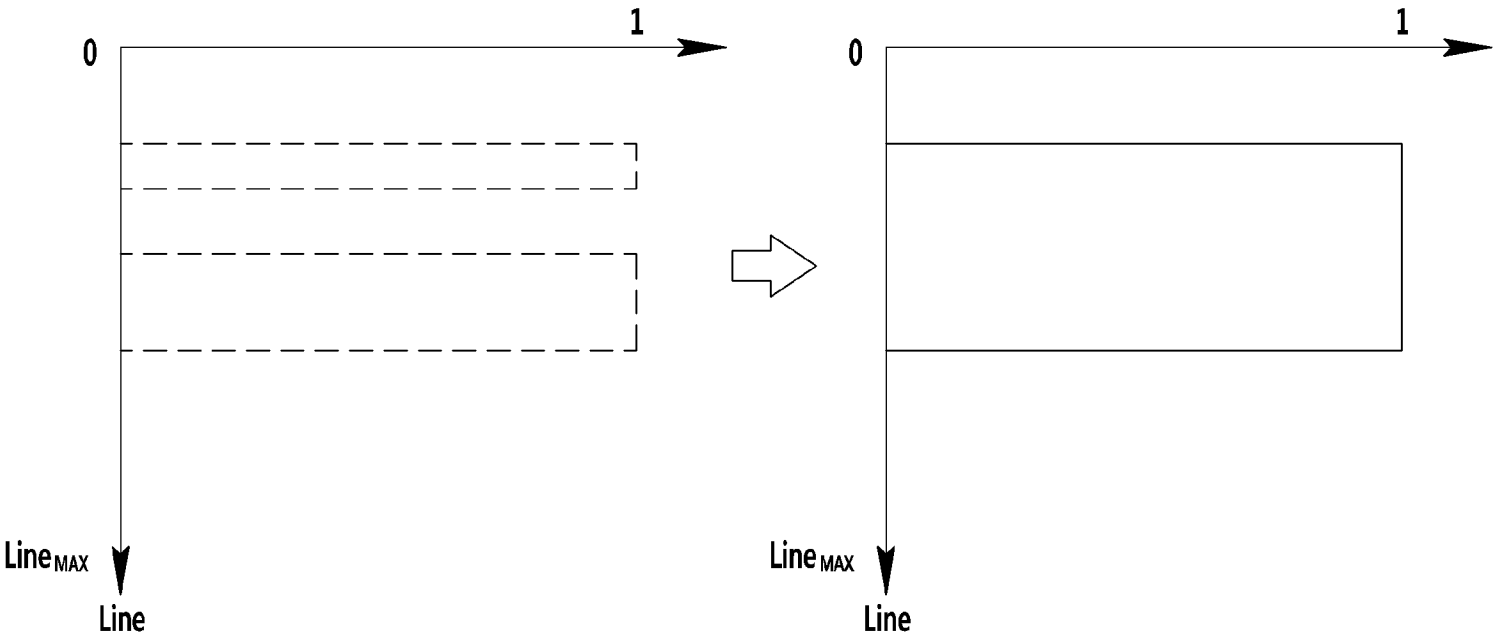
FIG. 5 is a diagram showing values stored in a line buffer memory of an exemplary embodiment of the display device according to the invention.

FIG. 3 is a flow chart showing an exemplary embodiment of a data processing of the display device according to the invention, FIG. 4 is a block diagram showing a data processing sequence in an exemplary embodiment of a signal controller according to the invention, and FIG. 5 is a diagram showing values stored in a line buffer memory of an exemplary embodiment of the display device according to the invention.

Referring to FIG. 3 and FIG. 4, data (e.g., image data) input to the signal controller 600 from outside is compared to determine whether the image data is still image data corresponding to the still image.

In such an embodiment, when the data is input to the signal controller 600 from the outside S10, the data input in a current frame (e.g., an n-th frame) and the data input in a previous frame (e.g., an (n−1)-th frame) are compared to each other S20. In an exemplary embodiment, storing of the data input in the previous frame (the (n−1)-th frame) may be performed by a frame memory 610 shown in FIG. 4. In such an embodiment, a comparator 620 shown in FIG. 4 may perform comparing the data input in a current frame (e.g., the n-th frame) and the data input in the previous frame (e.g., the (n−1)-th frame). In an exemplary embodiment, as shown in FIG. 4, the data input in the n-th frame is input to the frame memory 610 and the comparator 620, and the data input in the (n−1)-th frame or the previous frame is stored to the frame memory 610 and then transmitted to the comparator 620 in the n-th frame or the current frame. In the comparator 620, the data input in the n-th frame and the data input in the (n−1)-th frame are compared for each line/pixel to determine whether the data is motion picture data, which correspond to a motion picture image, or the still image data S30. The comparator 620 outputs a result of determination of whether the data is the motion picture or the still image to a line buffer memory 625, and the line buffer memory 625 stores the result corresponding to each line S40. In an exemplary embodiment, the output of the comparator 620 may be data of 2 bits (0 or 1), and in such an embodiment, zero (0) indicates the still image and 1 indicates the motion picture. In FIG. 5, a value stored to the line buffer memory 625 is indicated by a dotted line in a left graph. The left graph of FIG. 5 represents a result of comparing the image in one exemplary embodiment, in which the motion picture areas exist. However, the numbers and the positions of the still image and the motion picture image is not limited to those shown in the left graph of FIG. 5, and the still image and the motion picture may be variously combined. In an alternative exemplary embodiment, 1 may indicate the still image and zero (0) may indicate the motion picture.

In such an embodiment, the data driver 500 and the gate driver 400 are controlled to display the motion picture display and the still image based on the result of determination S50.

In an exemplary embodiment, as shown in FIG. 5, the motion picture divided by two dotted lines is collectively defined as a motion picture region as shown in the right graph and the rest of the portion is determined as the still image region, such that the image is displayed in the still image region with the lower frequency than the motion picture frequency, and the motion picture is displayed with the motion picture frequency in the motion picture region. According to an exemplary embodiment, as shown in FIG. 5, the still image display pixel row disposed between two motion picture display pixel rows is operated in a manner substantially the same as the motion picture display pixel row such that a single motion picture display pixel row is defined in the display area 300, thereby simplifying the display operation. However, in an alternative exemplary embodiment, two motion picture display pixel row groups may be separately determined, and the still image display pixel row therebetween may display the still image.

In an exemplary embodiment, when the still image display pixel row and the motion picture display pixel row are determined, the signal controller 600 may control the data driver 500 and the gate driver 400 to display the image, and an exemplary embodiment thereof will be described in detail with reference to FIG. 6 and FIG. 7.

Figure 6:
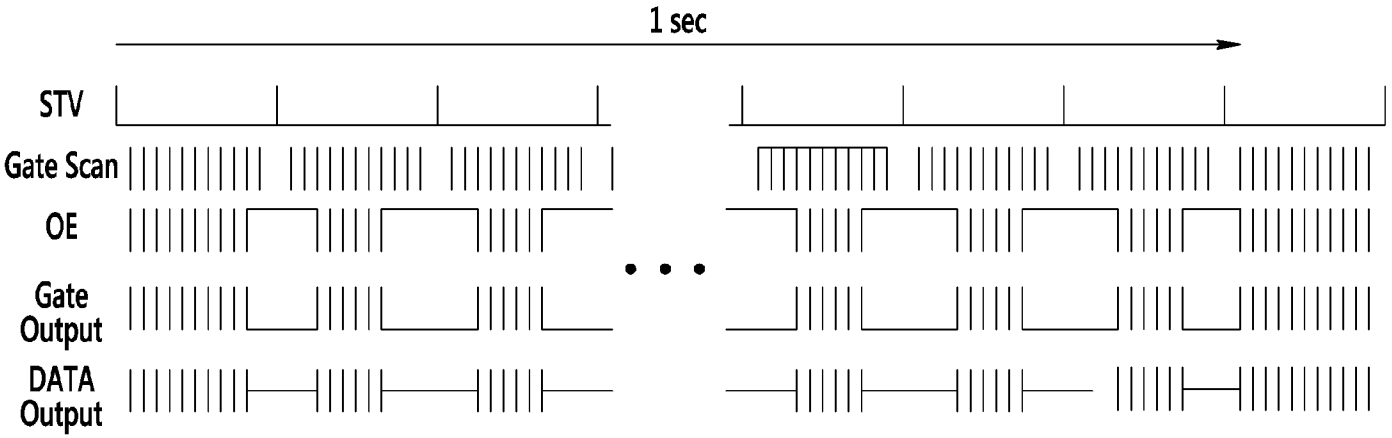
FIG. 6 is a signal timing diagram showing an exemplary embodiment of a method of analyzing a motion picture portion based on a result stored to a line buffer memory according to the invention.
Figure 7:
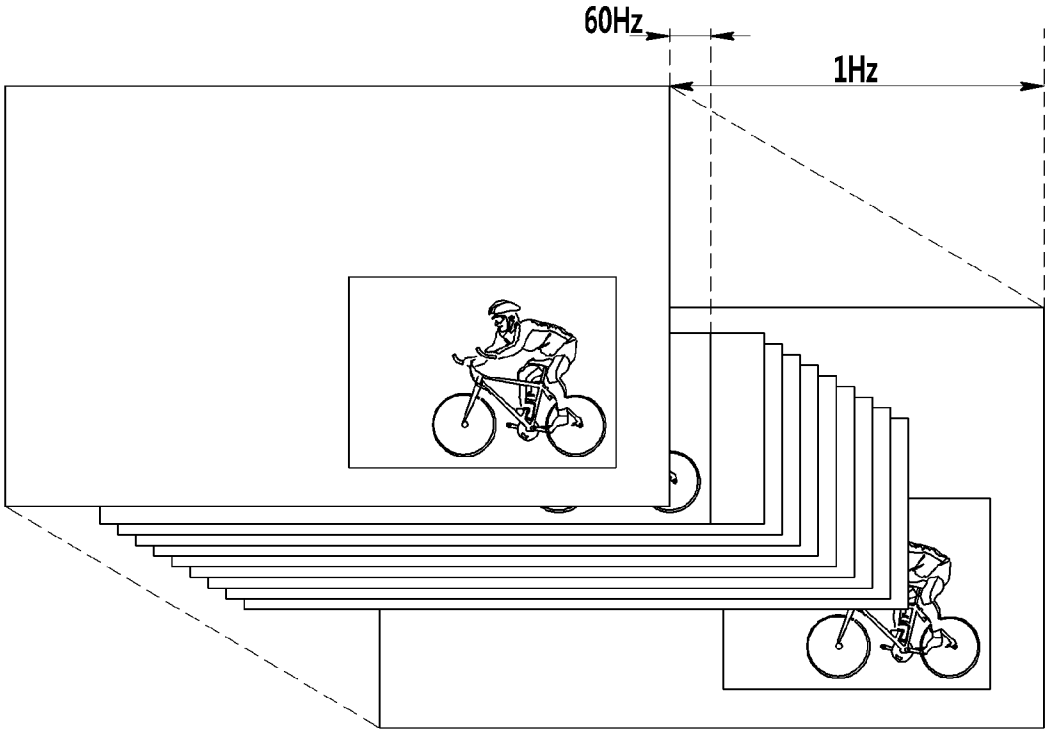
FIG. 7 is a view showing images displayed on a screen during a second in an exemplary embodiment of a display device according to the invention.

FIG. 6 is a signal timing diagram showing an exemplary embodiment of a method of analyzing a motion picture portion based on a result stored to a line buffer memory according to the invention, and FIG. 7 is a view showing images displayed on a screen during a second in an exemplary embodiment of a display device according to the invention.

Now, an exemplary embodiment of a method of controlling the gate driver 400 will be described with reference to FIG. 6. In an exemplary embodiment, where the motion picture frequency is 60 Hz, the image is displayed 60 times during one second (1 sec), and the vertical synchronization signal STV is generated 60 times during the one second (1 sec). A period between of a vertical synchronization signal STV, e.g., a period between current and next vertical synchronization signals, is corresponding to a period of 1 frame, and the gate scan signal corresponding to a number of the gate lines is generated during 1 frame. The output enable signal OE controls the output of the gate scan signal. In an exemplary embodiment of the invention, when the output enable signal OE has a low value, the gate-on voltage is output to the gate output for the gate scan signal, while when the output enable signal OE has a high value, the gate-on voltage is not output.

In an exemplary embodiment of the method of controlling the data driver 500 referred to in FIG. 6, the image data transmitted from the signal controller 600 is analyzed such that the data driver 500 outputs the data voltage to the data lines when the output enable signal OE has the low value, the data voltage is not output to the data lines when the output enable signal OE has the high value. In such an embodiment, when the output enable signal OE also has the high value, even if the data voltage is output by the data driver 500, the gate-on voltage is not transmitted to the pixel such that the pixel is not changed by the gate-on voltage, while the power consumption occurs by the operation of the data driver 500. Therefore, in an exemplary embodiment, as shown in FIG. 6, the data voltage is output only when the output enable signal OE has the low value such that the power consumption is substantially reduced.

In FIG. 6, a section where the output enable signal OE has the low value corresponds to timing for operating the motion picture display pixel row, and a section where the output enable signal OE has the high value corresponds to timing for operating the still image display pixel row.

In FIG. 6, the output enable signal OE in a leftmost frame and a rightmost frame has the low value during 1 frame. In the leftmost and the rightmost frames, the output enable signal OE has the low value during substantially the entire period of 1 frame such that the entire pixels rows include both the motion picture display pixel row and the still image display pixel row display in the corresponding frames. As shown in FIG. 6, in an exemplary embodiment, realization of the motion picture display and the still image may be generated every second.

FIG. 7 shows a conceptual diagram showing the images displayed based on the signals shown in FIG. 6.

In an exemplary embodiment, as shown in FIG. 7, the frame for displaying the entire image is displayed with the frequency of 1 hertz (Hz) (e.g., once per second), and the image displayed by the motion picture display pixel row is displayed 59 times with the frequency of 60 Hz (60 times per second) during the frame for displaying the entire image. As shown in FIG. 7, the motion picture display pixel row includes the motion picture display area 302 of FIG. 2 and the second still image display areas 301-2 of FIG. 2 disposed at the right side and the left side of the motion picture display area 302. The still second image display areas 301-2 included in the motion picture display pixel rows display the still image by continuously displaying the same image such that refreshing of the same image occurs.

In an exemplary embodiment, as shown in FIG. 6 and FIG. 7, the motion picture frequency is 60 Hz and the still image display frequency is 1 Hz, but not being limited thereto. In an alternative exemplary embodiment, the still image display frequency may be different for each still image display pixel row or may be changed.

Hereinafter, an exemplary embodiment, where the still image display frequency is different for each still image display pixel row, will be described with reference to FIG. 8 to FIG. 14.

Figure 8:
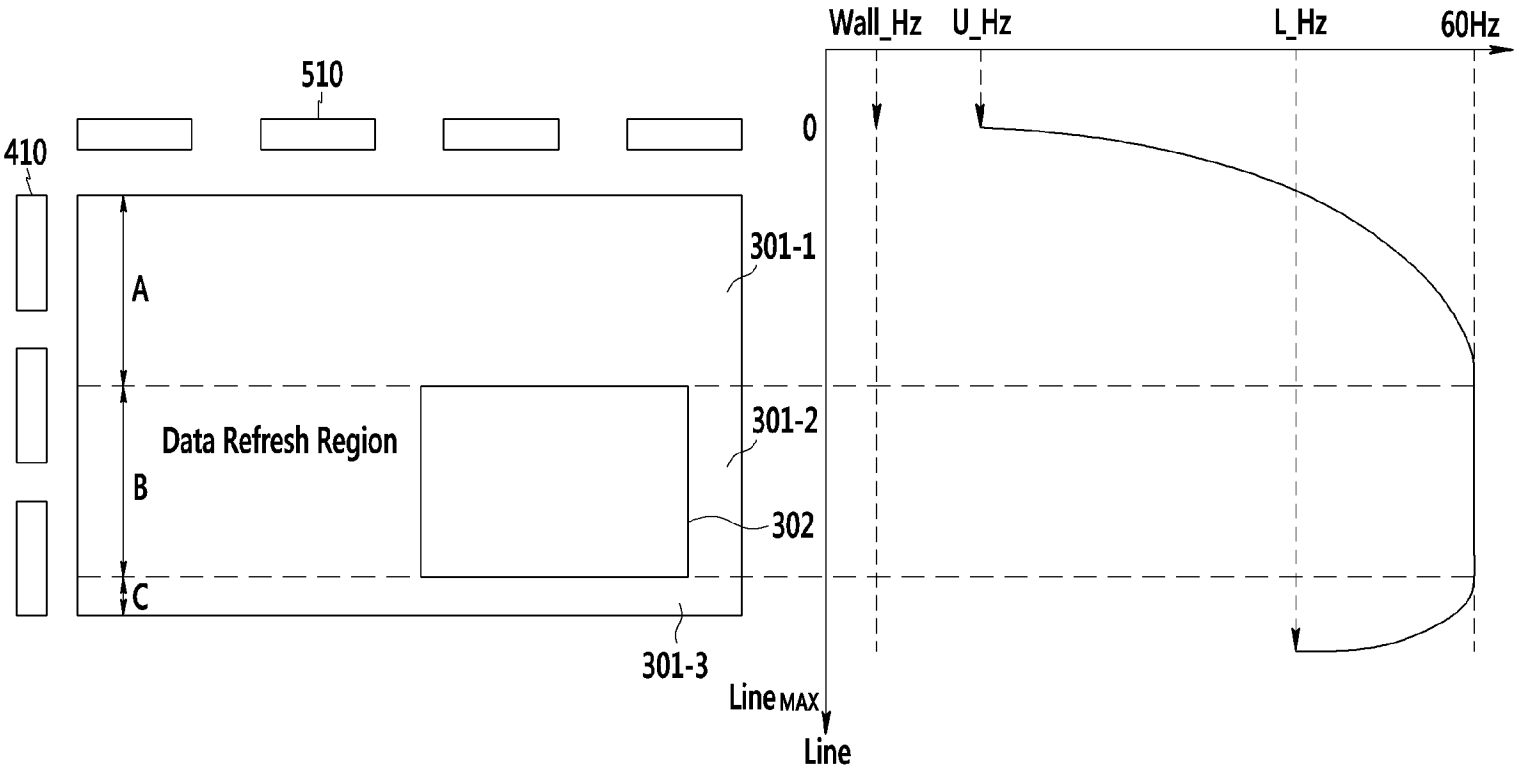
FIG. 8 is a graph of a frequency for each pixel row of to determine a frequency used for displaying an image according to the invention.

FIG. 8 is a graph of a frequency for each pixel row to determine a frequency used for displaying an image according to the invention.

In FIG. 8, a graph is shown at the right side, and an axis of the vertical direction in the graph represents a pixel row and corresponds to the display area 300 shown at the left side of the graph. In an exemplary embodiment, the pixel row corresponding to the motion picture display pixel row (e.g., pixel rows corresponding to the motion picture display area 302 and the second still image display area 301-2) is indicated by the dotted line. In FIG. 8, the axis of the horizontal direction of the graph represents the frequency, and FIG. 8 shows an exemplary embodiment, in which the motion picture frequency is 60 Hz. Also, an optimization still image display frequency Wall_Hz means a frequency that minimizes power consumption by analyzing the data of the still image display area. The optimization still image display frequency Wall_Hz may be determined based on the characteristics of the image pattern, the liquid crystal capacitor and the storage capacitor in the pixel. According to an exemplary embodiment, the image pattern of the still image display pixel row (e.g., pixel rows corresponding to the first and second still image display area 301-1 and 301-3) may be analyzed, and the optimization still image display frequency Wall_Hz corresponding thereto is thereby determined in a lookup table ("LUT") based on a result of the analysis. Analyzing the image pattern will be described in detail with reference to FIG. 15 to FIG. 18.

In an exemplary embodiment, the image pattern of each region is analyzed to determine the low frequency including a low frequency U_Hz (referred to as a upper still image display frequency) in the upper still image display area, e.g., the first still image display area 301-1, of the motion picture display pixel row and a low frequency L_Hz (referred to as a lower still image display frequency) in the lower still image display area, e.g., the third still image display area 301-3, of the motion picture display pixel row. According to an exemplary embodiment, the image pattern of each still image display pixel row may be analyzed to determine the still image display frequency U_Hz of the upper region and the still image display frequency L_Hz of the lower region in the LUT based on the result of the analysis. Analyzing the image pattern will be described in detail with reference to FIG. 15 to FIG. 18.

Figure 12:
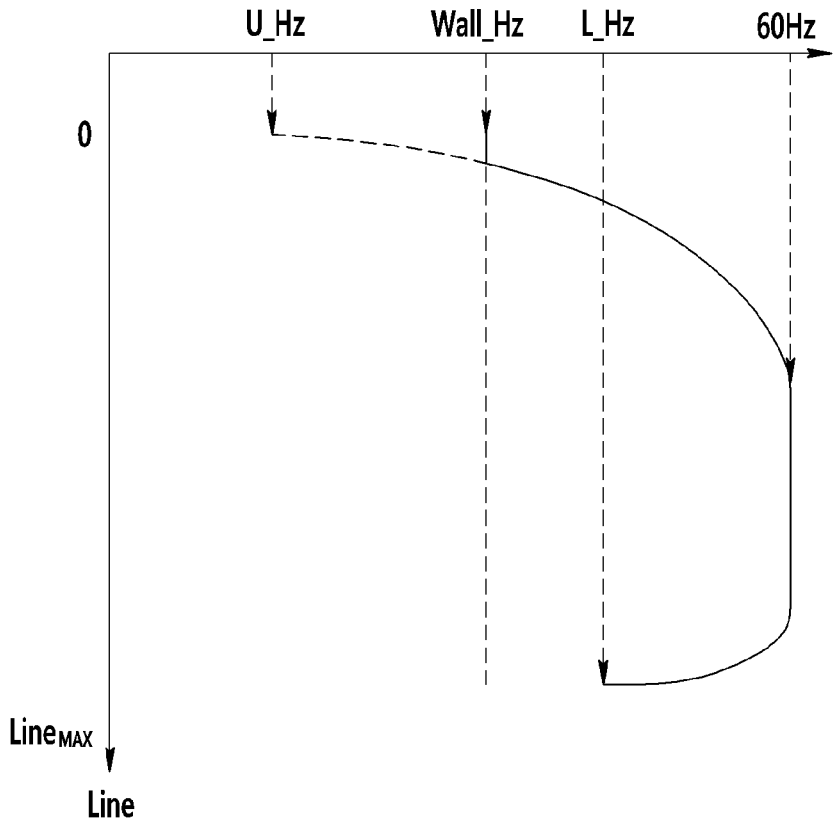
FIG. 12 and FIG. 13 are graphs of a frequency for each pixel row displayed with reference to a predetermined frequency in an alternative exemplary embodiment of a display device according to the invention.
Figure 13:
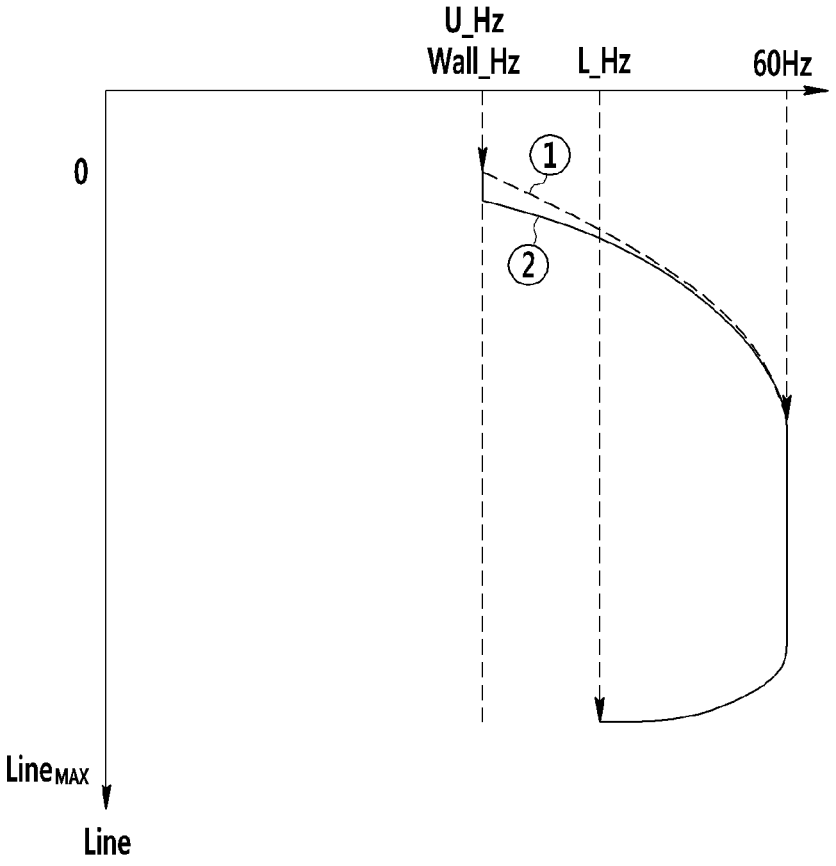

The optimization still image display frequency Wall_Hz, the still image display frequency U_Hz of the upper region and the still image display frequency L_Hz of the lower region, which are calculated by analyzing the image pattern in the upper and lower still image display areas of the motion picture display pixel row, are shown in the graph of FIG. 8, and may be arranged with various sequences, as shown in FIG. 12 and FIG. 13. In an exemplary embodiment, when the frequency sequence is arranged from low frequency to high frequency, the optimization still image display frequency Wall_Hz, the still image display frequency U_Hz of the upper region and the still image display frequency L_Hz of the lower region are sequentially arranged.

When the optimization still image display frequency Wall_Hz is the optimization frequency to represent the minimum power, the image quality may be deteriorated when using the lower frequency than the optimization frequency. In an exemplary embodiment, the still image is displayed with a frequency higher than the optimization frequency. In an exemplary embodiment, as shown in FIG. 8, the still image display frequency U_Hz of the upper region and the still image display frequency L_Hz of the lower region are higher than the optimization still image display frequency Wall_Hz, and the image is displayed based on the still image display frequency U_Hz of the upper region and the still image display frequency L_Hz of the lower region.

In such an embodiment, as shown in the graph of FIG. 8, the still image display frequency of a first pixel row, which is the farthest from the motion picture display pixel rows, and a last pixel row are determined as the still image display frequency U_Hz of the upper region and the still image display frequency L_Hz of the lower region, respectively. In such an embodiment, the still image display frequency is slowly increased from the first pixel row to the motion picture display row and decreased from the motion picture pixel row to last pixel rows such that the motion picture display pixel row is driven at 60 Hz. When the entire upper still image display area 301-1 is driven with the still image display frequency U_Hz of the upper region and the entire lower still image display area 301-3 is driven with the still image display frequency L_Hz of the lower region, the power consumption may be substantially reduced, but the quality of the displayed image may be impaired. In an exemplary embodiment, as shown in FIG. 8, the operation frequency is different for each pixel row in the still image display pixel row such that a difference between the motion picture display and the still image display that may occur near the motion picture display pixel row is not recognized.

An exemplary embodiment of driving each still image display pixel row with the different still image display frequency will be described with reference to FIG. 9.

Figure 9:
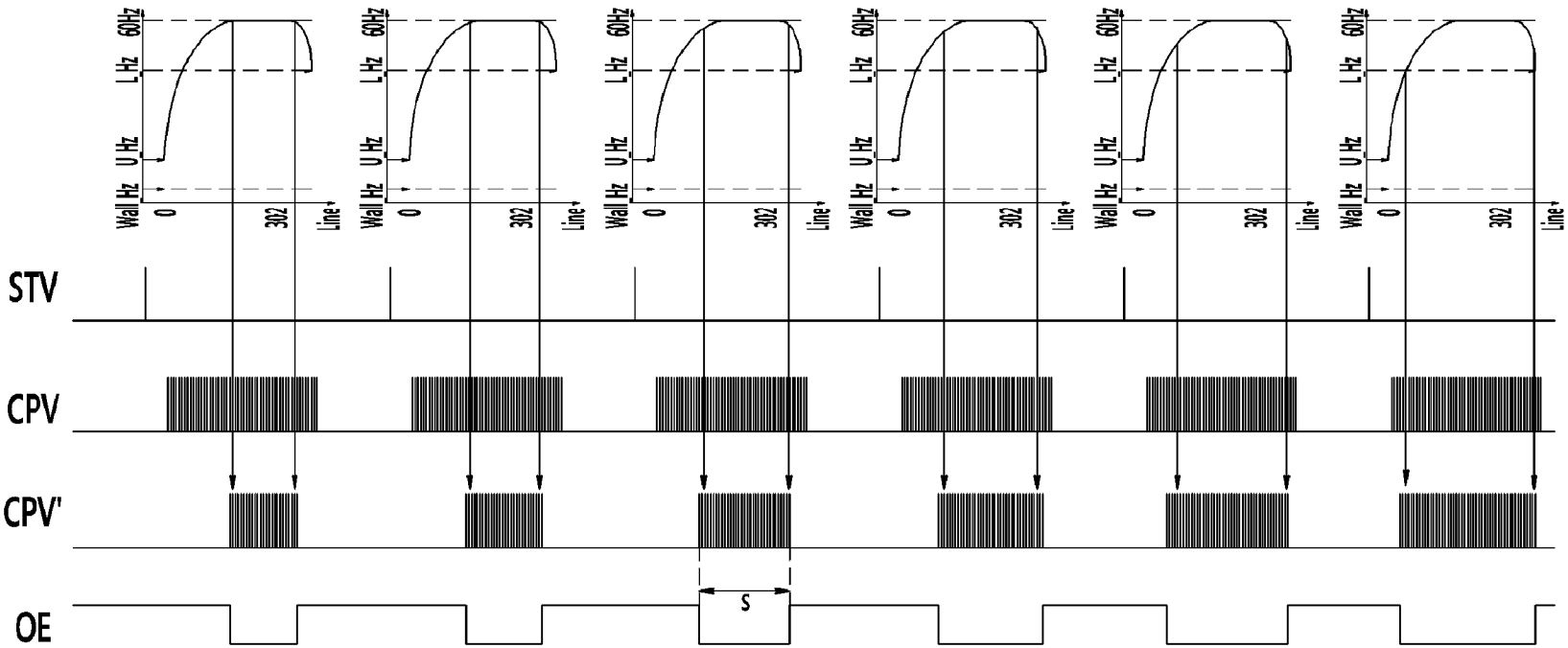
FIG. 9 is a diagram showing an exemplary embodiment of a method of displaying an image based on a predetermined frequency according to the invention.

FIG. 9 is a diagram showing an exemplary embodiment of a method of displaying an image based on a predetermined frequency according to the invention.

As shown in FIG. 9, the still image display pixel row displayed in each frame is controlled using the output enable signal OE.

In an exemplary embodiment, as shown in FIG. 9, a gate clock signal CPV is applied to output the gate-on voltage to all pixel rows in one frame during a period between a vertical synchronization signal STV and the next vertical synchronization signal STV. In an exemplary embodiment, the gate driver 400 generates the gate-on voltage based on the gate clock signal CPV.

In an exemplary embodiment of the invention, although the gate clock signal CPV is applied for all pixel rows, the screening is realized using the output enable signal OE such that an actual gate clock signal CPV' that is actually applied to the gate driver 400 is output, and the actual gate clock signal CPV' include a portion of the gate clock signal CPV where the output enable signal OE has the low value, but does not include the rest of the gate clock signal CPV where the output enable signal OE has the high value, as shown in FIG. 9.

In FIG. 9, a length of the section (s) where the output enable signal OE has the low value is changed for each frame. By changing the length of the low section(s) of the output enable signal OE, the still image display frequency for each still image display pixel row becomes different.

In an exemplary embodiment, the length of the low section(s) of the output enable signal OE is increased from the leftmost frame to the rightmost frame in FIG. 9. In such an embodiment, the number of the pixel rows where the data voltage is applied in the corresponding frame is increased from the leftmost frame to the rightmost frame in FIG. 9. In such an embodiment, the data voltage is only applied to the motion picture display pixel row in the leftmost frame, while the data voltage is applied to the still image display pixel rows disposed above and below the motion picture display pixel row in the display area when the frame moves to the rightmost frame, thereby realizing a refresh operation. In such an embodiment, the number of the still image display pixel rows to which the data voltage is applied is increased when the frame moves to the rightmost frame. According to an exemplary embodiment of a method of driving the gate lines, the motion picture display pixel row displays images in all frames such that the motion picture image is displayed with the motion picture frequency, and the still image display pixel row adjacent to the motion picture display pixel row displays the still image in more frames compared to the still image display pixel row far from the motion picture display pixel row such that the still image display frequency becomes higher at the still image display pixel row adjacent to the motion picture display pixel row.

In an exemplary embodiment, when the length of the low section(s) of the output enable signal OE is controlled to correspond to the frequency for each pixel row, the motion picture and the still image may be displayed with a frequency based on the output enable signal OE and the graph of FIG. 8.

According to an exemplary embodiment, as shown in FIG. 9, the still image is displayed with the still image display frequency, which is closer to the motion picture display pixel row in a portion of the frames included in the frame for displaying the still image, thereby having a higher frequency.

According to an exemplary embodiment, when determining the still image display frequency, the pixel rows are divided by predetermined blocks, and the still image frequency may be determined based on the predetermined blocks.

Hereinafter, an exemplary embodiment where the pixel rows are divided by the predetermined blocks will be described with reference to FIG. 10 and FIG. 11.

Figure 10:
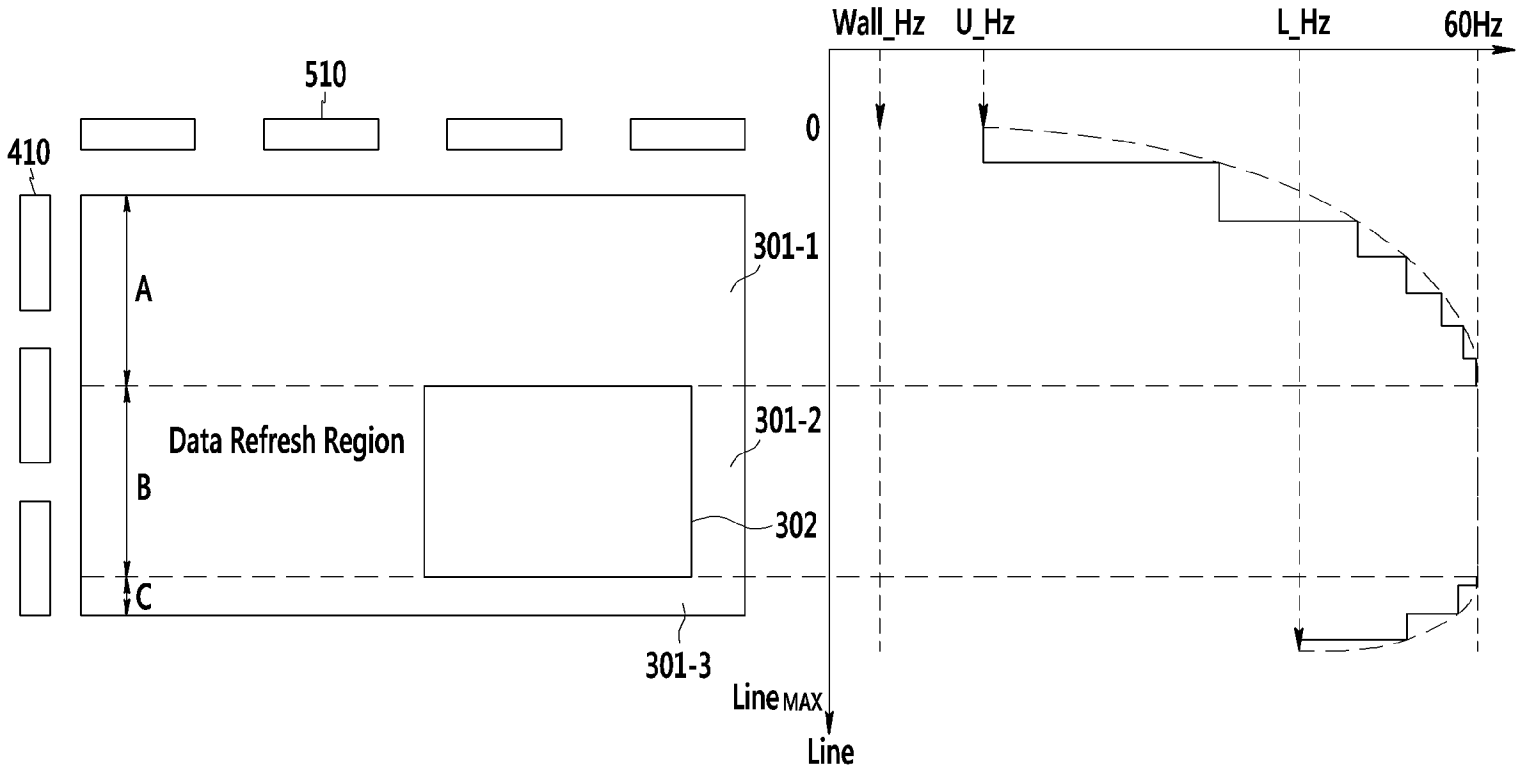
FIG. 10 and FIG. 11 are graphs of a frequency per each pixel row of an exemplary embodiment of a display device to determine a frequency for displaying an image according to the invention.
Figure 11:
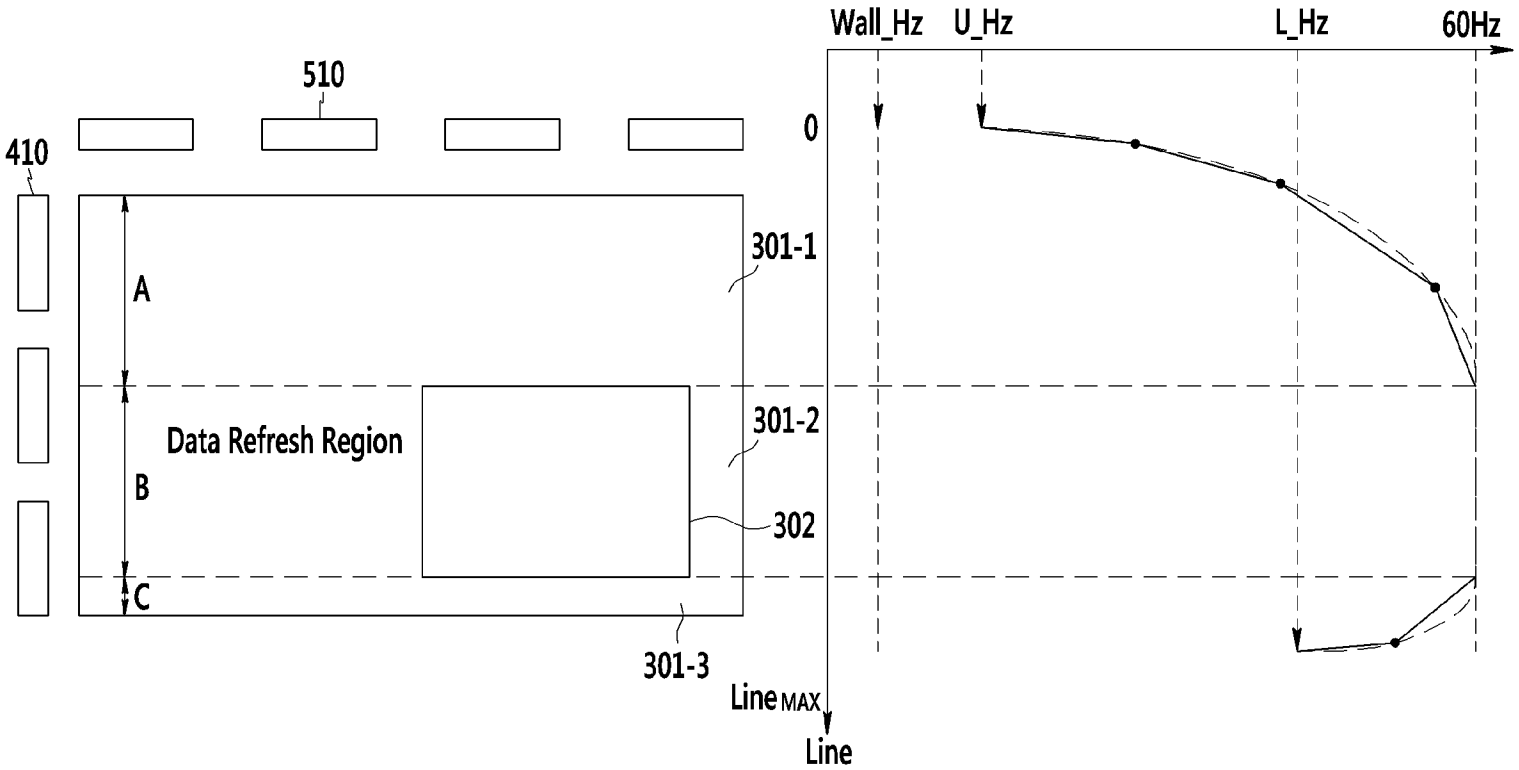

FIG. 10 and FIG. 11 are graph of a frequency per each pixel row of an exemplary embodiment of a display device to determine a frequency for displaying an image according to the invention.

Graphs shown in FIG. 10 and FIG. 11 are substantially the same as the graph of FIG. 8. In the exemplary embodiment of FIG. 8, the still image display frequency is determined for each pixel row and the still image display frequency are stored for each pixel row such that a size of a storage space (e.g., LUT or memory) is substantially great.

In an exemplary embodiment of FIG. 10 and FIG. 11, the size of the storage space may be substantially reduced.

Firstly, FIG. 10 shows an exemplary embodiment in which the pixel row in the display panel is divided into a plurality of pixel row blocks, and the still image display frequency in each of the pixel row blocks is determined as a predetermined value.

In an exemplary embodiment, as shown in FIG. 10, the upper region may be divided into seven pixel row blocks and the lower region may be divided into four pixel row blocks, but not being limited thereto.

The seven pixel row blocks of the upper region correspond to the different still image display frequencies, and the pixel rows in a same pixel row block display the still image with a same still image display frequency. A pixel row block of the upper region, which is close to the motion picture display pixel row, have a higher still image display frequency than a pixel row block of the upper region, which is far from the motion picture display pixel row, and have the value in a range from the still image display frequency U_Hz of the upper region to the motion picture display frequency (e.g., 60 Hz).

The four pixel row blocks of the lower region have different still image display frequencies, and the pixel rows in a same pixel row block display the still image with a same still image display frequency. A pixel row block of the lower region, which is close to the motion picture display pixel row, have a higher still image display frequency than a pixel row block of the lower region, which is far from the motion picture display pixel row, and have the value in a range from the still image display frequency L_Hz of the lower region to the motion picture display frequency (e.g., 60 Hz).

In an exemplary embodiment, each of the pixel row blocks of the upper region and the lower region may include a same number of pixel rows. In an alternative exemplary embodiment, the pixel row blocks of the upper region and the lower region may include different numbers of pixel rows.

In an exemplary embodiment, as shown in FIG. 11, a plurality of still image display frequencies are predetermined, and the pixel row block is divided with reference to the pixel row corresponding to the predetermined still image display frequencies. In such an embodiment, each pixel row block of the upper region has one of the still image display frequency U_Hz of the upper region, the motion picture display frequency 60 Hz and a plurality of predetermined still image display frequencies as a maximum value or a minimum value of the still image display frequency thereof. The pixel row included in the pixel row block having the maximum value and minimum value determines the still image display frequency for each pixel row by an interpolation. The still image display frequency displayed by each pixel row in one pixel row block may be linearly increased, as shown in FIG. 11.

In an exemplary embodiment, each pixel row block of the lower region has one of the still image display frequency L_Hz of the lower region, the motion picture display frequency 60 Hz, and a plurality of predetermined still image display frequencies as the maximum value and the minimum value of the still image display frequency thereof. The pixel row included in the pixel row block having the maximum value and minimum value determines the still image display frequency for each pixel row by interpolation. The still image display frequency displayed by each pixel row in one pixel row block may be linearly increased.

According to an exemplary embodiment, a plurality of still image display frequencies may have values that are predetermined. In an exemplary embodiment, the pixel row block may be divided with reference to the pixel rows that display the still image with the predetermined still image display frequency, or the pixel row block may be divided with reference to a reference pixel row, and the still image display frequency of the reference pixel row may be used as is the still image display frequency of the pixel row block corresponding to the reference pixel row.

Next, a graph of the display frequency for each pixel row of another exemplary embodiment of the display device will be described with reference to FIG. 12 and FIG. 13.

FIG. 12 and FIG. 13 are graph of a frequency for each pixel row displayed with reference to a predetermined frequency in an alternative exemplary embodiment of a display device according to the invention.

In an exemplary embodiment, as shown in FIG. 12, the optimization still image display frequency Wall_Hz is set to be higher than the still image display frequency U_Hz of the upper region such that the still image is not displayed with a frequency that is less than the optimization still image display frequency Wall_Hz when displaying the still image in the upper region. In FIG. 12, a portion from the still image display frequency U_Hz of the upper region to the optimization still image display frequency Wall_Hz is indicated by a dotted line, and the corresponding frequency is not used in such an embodiment.

In an exemplary embodiment, as shown in FIG. 12, when the frequency of the upper region is increased with a curved line from the still image display frequency U_Hz of the upper region to the motion picture frequency (e.g., 60 Hz), the values that are less than the optimization still image display frequency Wall_Hz are determined to be the optimization still image display frequency Wall_Hz.

In an alternative exemplary embodiment, the frequency of the upper region may be increased from the optimization still image display frequency Wall_Hz to the motion picture frequency with the curved line shape.

In an alternative exemplary embodiment, as shown in FIG. 13, the optimization still image display frequency Wall_Hz and the still image display frequency U_Hz of the upper region have substantially the same value as each other. In the exemplary embodiment of FIG. 13, referring to a first curved line ①, the frequency may be increased with the curved line shape from the still image display frequency U_Hz of the upper region to the motion picture frequency (e.g., 60 Hz). Referring to a second curved line ②, according to an exemplary embodiment, the same frequency is maintained from the still image display frequency U_Hz of the upper region to a predetermined pixel row, and then the frequency is increased with the curved line shape to the motion picture frequency.

An exemplary embodiment of the invention is not limited to the exemplary embodiments shown in FIG. 8, FIG. 12 and FIG. 13. In an exemplary embodiment, various graphs may be provided by the optimization still image display frequency Wall_Hz, the still image display frequency U_Hz of the upper region, and the still image display frequency L_Hz of the lower region. In an exemplary embodiment, the still image display frequency L_Hz of the lower region may be set to be lower than the still image display frequency U_Hz of the upper region or the optimization still image display frequency Wall_Hz.

In an exemplary embodiment, the curved line shape that is increased from the still image display frequency U_Hz of the upper region and the still image display frequency L_Hz of the lower region to the motion picture frequency may be variously modified, and may be changed based on a distance to the motion picture display pixel row and characteristics of the display panel. In an exemplary embodiment, the lookup table may store information for the shape of the curved line or the value that is increased between the pixel rows.

Next, an exemplary embodiment of a step of determining a frequency for a pixel row according to the invention will be described in detail with reference to FIG. 14.

Figure 14:
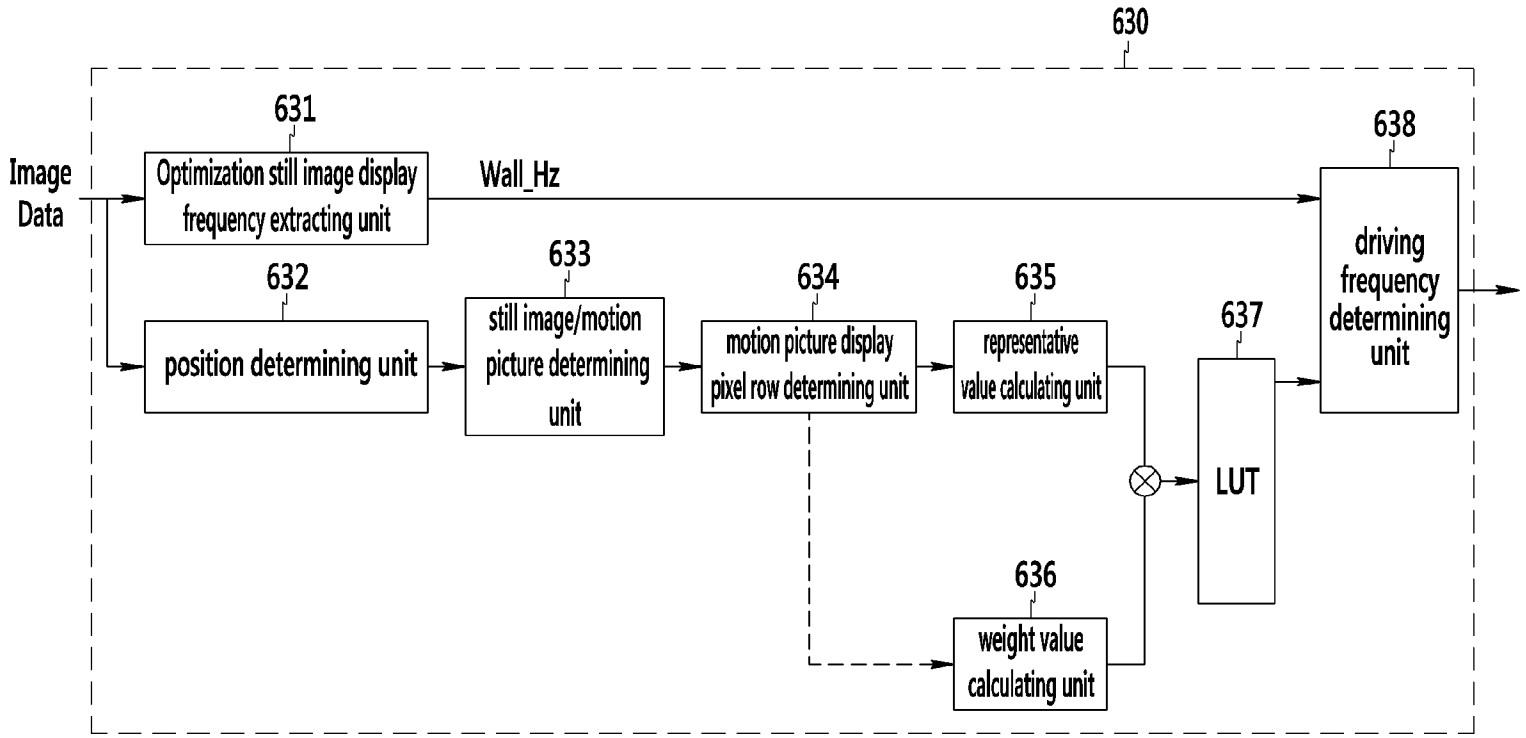
FIG. 14 is a block diagram showing an exemplary embodiment of a driving frequency determining unit for determining a frequency for each pixel row according to the invention.

FIG. 14 is a block diagram showing an exemplary embodiment of a driving frequency determining unit for determining a frequency for each pixel row according to the invention.

The block diagram shown in FIG. 14 shows a driving frequency determining unit 630 included in the signal controller 600.

In an exemplary embodiment, the driving frequency determining unit 630 include an optimization still image display frequency extracting unit 631, a position determining unit 632, a still image/motion picture determining unit 633, a motion picture display pixel row setting unit 634, a representative value calculating unit 635, a weight value calculating unit 636, an LUT 637 and a driving frequency determining unit 638.

In an exemplary embodiment, when image data (Image Data of FIG. 14) is input to the signal controller 600, the input image data is transmitted to the driving frequency determining unit 630. The image data input to the driving frequency determining unit 630 is transmitted to the optimization still image display frequency extracting unit 631 to calculate the optimization still image display frequency Wall_Hz. The optimization still image display frequency extracting unit 631 calculates a representative value based on the image pattern of the still image display pixel rows (e.g., the first and third still image display area 301-1, 301-3), and the corresponding optimization still image display frequency Wall_Hz is selected from the LUT based on the calculated representative value. Calculating the representative value will be described in detail with reference to FIG. 15 to FIG. 18

The image data input to the driving frequency determining unit 630 is also input to the position determining unit 632. The position determining unit 632 determines a position of the image data, that is, a position of a pixel of the display panel, to which the image data applied. The data is divided for each pixel row based on the determined position, and the data of the divided pixel row is input to the still image/motion picture determining unit 633. The still image/motion picture determining unit 633 compares the image data of the current frame (e.g., an n-th frame) and the image data of the previous frame (e.g., an (n−1)-th frame) based on the pixel row to determine whether the image data is the still image data or the motion picture data. The still image/motion picture determining unit 633 may include the frame memory 610 and the comparator 620 of FIG. 4 to compare the image data of the previous frame (e.g., the (n−1)-th frame) and the image data of the current frame (e.g., the n-th frame).

The result of determining of whether the image data is the still image data or the motion picture data is transmitted to the motion picture display pixel row setting unit 634 to set whether a portion corresponding to the image data is the motion picture display pixel row or the still image display pixel row in the display area 300.

As described above, in an exemplary embodiment, when the characteristic of each pixel row is set, the image data is transmitted to the representative value calculating unit 635 and the weight value calculating unit 636 to calculate a representative value and a weight value for each pixel row.

The calculated representative value and the calculated weight value are multiplied by each other, and the driving frequency for each pixel row is selected from the LUT 637 based on the value acquired by multiplying the calculated representative value and the calculated weight value, and the still image display frequency L_Hz of the lower region and the still image display frequency U_Hz of the upper region are selected. The LUT 637 stores a frequency corresponding to the multiplication of the representative value and the weight value. In an alternative exemplary embodiment, the LUT 637 may store a frequency corresponding to the representative value.

In an exemplary embodiment, the optimization still image display frequency Wall_Hz selected from the LUT 637, the driving frequency for each pixel row, the still image display frequency L_Hz of the lower region, and the still image display frequency U_Hz of the upper region are applied to and modified by the driving frequency determining unit 638 to finally determine the driving frequency for each pixel row. In such an embodiment, the driving frequency determining unit 638 determines whether the frequency from the LUT is appropriate to determine the final driving frequency. The determined driving frequency may be represented by the graphs of FIG. 8, FIG. 12 and FIG. 13.

In an exemplary embodiment, the size and the timing of the low section of the output enable signal OE is controlled as shown in FIG. 9 based on the driving frequency for each pixel row that is determined as described above, thereby displaying the image.

In an exemplary embodiment, as shown in FIG. 14, the driving frequency may be determined based on the representative value and the weight value of each pixel row, but not being limited thereto. Hereinafter, an alternative exemplary embodiment for determining the representative value and the weight value will be representatively described with reference to FIG. 15 to FIG. 18.

FIG. 15 to FIG. 18 are graphs showing exemplary embodiments of a method of selecting a representative value and weight value according to the invention.

Figure 15:
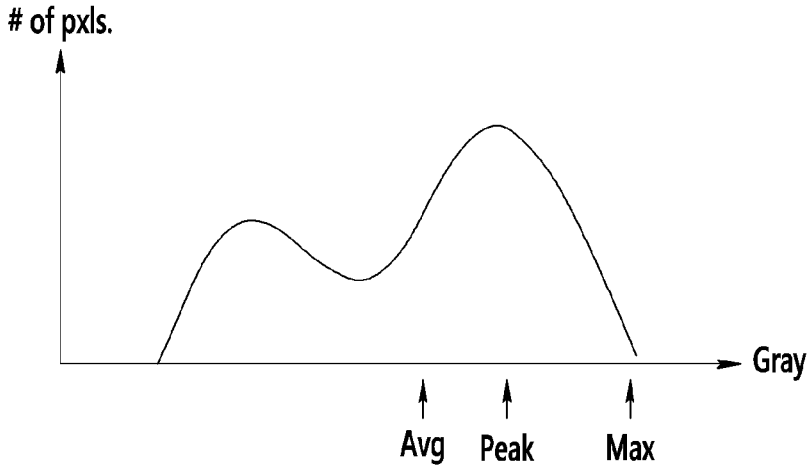
FIG. 15 to FIG. 18 are graphs showing exemplary embodiments of a method of selecting a representative value and weight value according to the invention.

Firstly, FIG. 15 shows an exemplary embodiment, where a representative grayscale value is calculated as the representative value.

FIG. 15 is a graph showing a number of the pixels for display each grayscale in a pixel row or in a region to calculate the representative value. In the graph of FIG. 15, one of an average value (Avg) of the grayscale values, a peak value (Peak) of the grayscale values, which is a grayscale value corresponding to the largest value of the number of the pixels, and a maximum gray value (Max) of the grayscale values may be used as the representative value.

Figure 16:
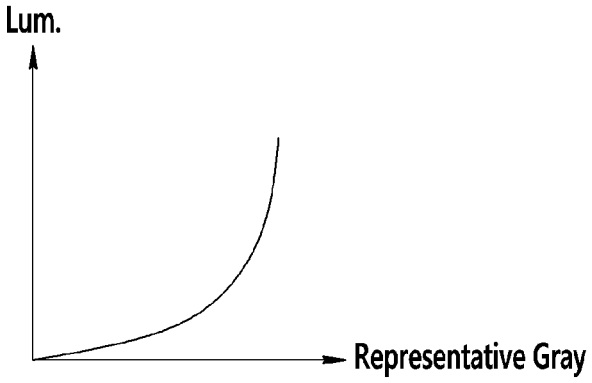

In an alternative exemplary embodiment, as shown in FIG. 16, the luminance value (Lum.) may be used as the representative value. As shown in FIG. 16, when determining the representative grayscale (Representative Gray), the luminance value of the corresponding representative gray value is used as the representative value. The curved line shown in FIG. 16 is a gamma curve.

Figure 17:
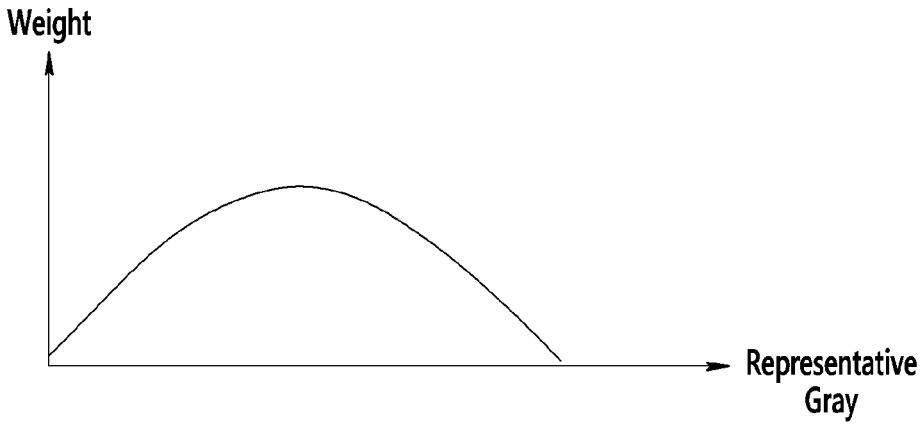
Figure 18:
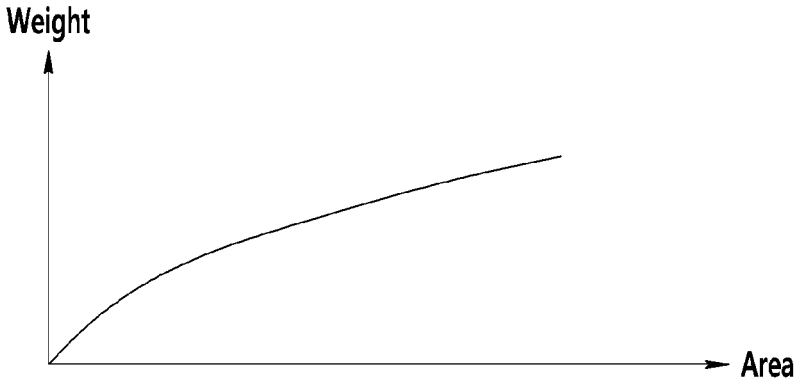

FIG. 17 and FIG. 18 are graphs for calculating the weight value (Weight).

In an exemplary embodiment, as shown in FIG. 17, when the representative grayscale (Gray) is the middle gray value, a large weight value is provided, and when the representative grayscale (Gray) is the maximum value or the minimum value, a small weight value is provided. In one exemplary embodiment, for example, the weight values are determined to substantially minimize or effectively prevent a flicker effect. A viewer may recognize the change of the luminance as the grayscale is changed when the luminance displayed by the pixel is substantially low or high. Accordingly, in such an embodiment, the weight value is decreased to decrease the representative value when the representative grayscale have a high or low value, and the large weight value is provided to increase the representative value as the luminance change is small on the middle gray. In an exemplary embodiment, as shown in FIG. 17, the weight value is provided based on the representative grayscale value, but not being limited thereto. In an alternative exemplary embodiment, the weight value may be provided based on the luminance value. In such an embodiment, when the luminance value has the middle luminance value, the weight value is large, and when the luminance value has the small or large value, the weight value is small.

In an alternative exemplary embodiment, as shown in FIG. 18, the weight value is increased as the area is increased after calculating the area corresponding to the representative value. In such an embodiment, the weight value is provided when the number of the pixels corresponding to the representative value is substantially great, and the large weight value may be provided when the number of the pixels corresponding to the representative value is substantially great.

According to an exemplary embodiment, both of the weight values of FIG. 17 and FIG. 18 may be calculated and used, and in such an embodiment, the frequency may be selected based on a value acquired by multiplying the two weight values and the representative value.

In an exemplary embodiment, as shown in FIG. 15 to FIG. 18, the representative value and the weight value may be calculated, and the reference value to select the frequency from the LUT 637 is changed based on the change of the representative value and the weight value. Accordingly, in an exemplary embodiment, various representative values or various weight values may be selected and used in the display device.

According to an exemplary embodiment of the invention, the still image display pixel row is operated with the lower frequency to reduce the power consumption. However, in the driving of the low frequency, the display deterioration may occur due to current leakage in the off state of the thin film transistor included in the pixel. In an exemplary embodiment, the optimization still image display frequency Wall_Hz is predetermined to display the image with the low frequency within a limitation that the display quality is not deteriorated according to the characteristic of the pixel. If the current leakage is decreased in the off state of the thin film transistor, the optimization still image display frequency Wall_Hz may be further decreased. Accordingly, in an exemplary embodiment, the thin film transistor in the pixel of the display device may use an oxide semiconductor as the channel layer. In such an embodiment, the leakage current of the off state is small in the thin film transistor including the oxide semiconductor as the channel layer, when compared to a case that the amorphous silicon is applied to the thin film transistor, such the optimization still image display frequency Wall_Hz may be further decreased. In an exemplary embodiment, where the thin film transistor including amorphous silicon is used, the low power consumption driving may be realized by controlling the optimization still image display frequency Wall_Hz.

In an alternative exemplary embodiment, the thin film transistor may include the channel layer including polysilicon.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of driving a display device, the method comprising:

determining each of a plurality of pixel rows of the display device as one of a motion picture display pixel row and a still image display pixel row by comparing image data of each of the pixel rows in a current frame and in a previous frame; and driving the motion picture display pixel row with a motion picture frequency and driving the still image display pixel row with a still image display frequency, which is lower than or equal to the motion picture frequency, wherein a plurality of still image display pixel rows are driven with at least two still image frequencies are two different frequencies from each other, all of which are lower than the motion picture frequency, and wherein the plurality of still image display pixel rows include a first pixel row which is driven with a first still image display frequency and a second pixel row which is driven with a second still image display frequency, the first pixel row is closer to the motion picture display pixel row than the second pixel row, and the first still image display frequency is greater than the second still image display frequency.

2. The method of claim 1, wherein the motion picture display pixel row comprises a motion picture display area and a refresh region, which are disposed along a same gate line.

3. The method of claim 1, wherein the determining each of the pixel rows of the display device as one of the motion picture display pixel row and the still image display pixel row by the comparing the image data of the current frame and the image data of the previous frame comprises:

outputting the image data of the previous frame, which is stored in a frame memory of the display device, to a comparator of the display device, and storing the image data of the current frame to the frame memory of the display device; and comparing the image data of the current frame and the image data of the previous frame using the comparator.

4. The method of claim 3, wherein the image data in the current frame and the image data in the previous frame are compared for each of the pixel rows in the comparator to compare whether the still image or the motion picture is displayed for each of the pixel rows.

5. The method of claim 4, further comprising:

storing data corresponding to a result of the comparison in the comparator to a line buffer memory of the display device.

6. The method of claim 5, wherein the data which is output from the comparator and is stored to the line buffer memory is data of two bits, wherein zero (0) represents the still image and 1 represents the motion picture.

7. The method of claim 4, wherein when the still image display pixel row is disposed between two motion picture display pixel rows, the still image display pixel row is operated with the motion picture frequency.

8. The method of claim 4, wherein the driving the motion picture display pixel row with the motion picture frequency and the driving the still image display pixel row with the still image display frequency comprises controlling transmission of a gate-on voltage to a gate line of the display device using an output enable signal.

9. The method of claim 8, wherein when the gate-on voltage is not applied to a pixel connected to the gate line based on the output enable signal, a data voltage is controlled not to be applied to the pixel.

10. The method of claim 1, wherein the driving of the still image display pixel row with the still image display frequency, which is lower than or equal to the motion picture frequency comprises:

analyzing an optimization still image display frequency;

determining an upper still image display frequency for the still image display pixel rows in an upper still image display area positioned above the motion picture pixel row; and determining a lower still image display frequency for the still image display pixel rows in a lower still image display area positioned below the motion picture pixel row.

11. The method of claim 10, wherein the analyzing the optimization still image display frequency comprises:

calculating a representative value based on an image pattern of the still image display pixel row; and selecting the optimization still image display frequency from a lookup table of the display device based on the calculated representative value.

12. The method of claim 11, wherein each of the determining the upper still image display frequency and the determining the lower still image display frequency comprises:

calculating a representative value of a corresponding still image display pixel row; and selecting the upper still image display frequency and the lower still image display frequency from the lookup table based on the calculated representative value of the corresponding still image display pixel row.

13. The method of claim 12, wherein each of the determining the upper still image display frequency and the determining the lower still image display frequency further comprises calculating a weight value of the corresponding still image display pixel row, and the upper still image display frequency and the lower still image display frequency are selected from the lookup table based on a value acquired by multiplying the weight value and the calculated representative value of the corresponding still image display pixel row.

14. The method of claim 10, wherein the still image display frequency of the still image display pixel row in the upper still image display area is gradually increased from the upper still image display frequency to the motion picture frequency as the still image display pixel row goes toward the motion picture display pixel row, and the still image display frequency of the still image display pixel rows in the lower still image display area is gradually increased from the lower still image display frequency to the motion picture frequency as the still image display pixel row goes toward the motion picture display pixel row.

15. The method of claim 14, wherein the still image display frequency is increased nonlinearly from the upper still image display frequency to the motion picture frequency and from the lower still image display frequency to the motion picture frequency.

16. The method of claim 10, wherein when the upper still image display frequency or the lower still image display frequency is lower than the optimization still image display frequency, a corresponding still image display pixel row is operated with the optimization still image display frequency.

17. A driving apparatus of a display device comprising:

a still image/motion picture determining unit which receives an image data input from outside and determines whether a pixel row corresponding to the image data is a motion picture display pixel row or a still image display pixel row;

a representative value calculating unit which calculates a representative value for each pixel row;

a lookup table which stores a frequency corresponding to the representative value; and a driving frequency determining unit which determines whether the frequency corresponding to the representative value from the lookup table is appropriate to determine a final driving frequency, wherein the motion picture display pixel row is driven with a motion picture frequency, the still image display pixel row is driven with a still image display frequency, which is lower than or equal to the motion picture frequency, a plurality of the still image display pixel rows are driven with at least two still image frequencies are two different frequencies from each other, all of which are lower than the motion picture frequency, and wherein the plurality of still image display pixel rows include a first pixel row which is driven with a first still image display frequency and a second pixel row which is driven with a second still image display frequency, the first pixel row is closer to the motion picture display pixel row than the second pixel row, and the first still image display frequency is greater than the second still image display frequency.

18. The driving apparatus of claim 17, further comprising:

a weight value calculating unit which provides a weight value, wherein the frequency is selected from the lookup table based on a value acquired by multiplying the representative value and the weight value.

19. The driving apparatus of claim 18, further comprising:

an optimization still image display frequency extracting unit which calculates the representative value based on an image pattern of the still image display pixel row and selects a corresponding optimization still image display frequency from the lookup table based on the calculated representative value.

20. The driving apparatus of claim 19, wherein the representative value is a grayscale value or a luminance value.

21. The driving apparatus of claim 20, wherein the representative value is one of an average value, a peak value and a maximum grayscale value.

22. The driving apparatus of claim 21, wherein the weight value for a middle grayscale is greater than the weight value for a maximum or a minimum grayscale.

23. The driving apparatus of claim 21, wherein an area corresponding to the representative value is calculated, and the weight value is determined based on the area such that the weight value increases as the area increases.

24. The driving apparatus of claim 18, further comprising:

a position determining unit which determines a portion of a pixel of the display panel which receives the image data, wherein the position determined by the position determining unit is transmitted to the still image/motion picture determining unit.

25. The driving apparatus of claim 24, further comprising:

a motion picture display pixel row determining unit which receives the position determined by the position determining unit and determines whether a pixel row including the pixel is the motion picture display pixel row or the still image display pixel row.

26. The method of claim 1, wherein:

any of the motion picture display pixel row is not disposed between the first pixel row and the second pixel row.

27. The driving apparatus of claim 17, wherein:

any of the motion picture display pixel row is not disposed between the first pixel row and the second pixel row.

* * * * *